US010470967B2

(12) United States Patent
Wright

(10) Patent No.: US 10,470,967 B2
(45) Date of Patent: Nov. 12, 2019

(54) BESPOKE COMPRESSION THERAPY DEVICE

(71) Applicant: TACTILE SYSTEMS TECHNOLOGY, INC., Minneapolis, MN (US)

(72) Inventor: Carol Lynn Wright, Pittsburgh, PA (US)

( * ) Notice: Subject to any disclaimer, the term of this patent is extended or adjusted under 35 U.S.C. 154(b) by 1030 days.

(21) Appl. No.: 14/600,762

(22) Filed: Jan. 20, 2015

(65) Prior Publication Data

US 2015/0202116 A1 Jul. 23, 2015

Related U.S. Application Data

(60) Provisional application No. 61/929,217, filed on Jan. 20, 2014.

(51) Int. Cl.
*A61H 9/00* (2006.01)

(52) U.S. Cl.
CPC ... *A61H 9/0078* (2013.01); *A61H 2201/1604* (2013.01); *A61H 2201/164* (2013.01);
(Continued)

(58) Field of Classification Search
CPC ..... A61H 9/0078; A61H 2201/164; A61H 2230/207; A61H 2201/1614; A61H 2230/85; A61H 2230/30; A61H 2201/501; A61H 2201/165; A61H 2209/00; A61H 2201/5097; A61H 2201/5087; A61H 2201/1619; A61H 2201/1609; A61H 2201/5071; A61H 2201/1647;
(Continued)

(56) References Cited

U.S. PATENT DOCUMENTS 3,811,431 A 5/1974 Apstein
4,013,069 A 3/1977 Hasty
(Continued)

FOREIGN PATENT DOCUMENTS

DE 19846922 A1 4/2000
FR 2682279 A1 4/1993
(Continued)

OTHER PUBLICATIONS

Extended European Search Report for EP 13760396 dated Sep. 30, 2015.

*Primary Examiner* — Steven O Douglas
(74) *Attorney, Agent, or Firm* — Mueting, Raasch & Gebhardt, P.A.

(57) ABSTRACT

A compression therapy device may include a wearable article having independently inflatable and deflatable sealed cells. The location of the sealed cells in the article may be tailored to the anatomy of the device user. A method of providing the therapy device may include measuring one or more anatomical areas on the patient where compression is desired, providing the measurement to a device provider, and receiving an article having multiple sealed cells localized at the one or more anatomical areas. A method of manufacturing the therapy device may include receiving a measurement of an anatomical feature of a patient and determining a configuration of seals to be incorporated in a template article. The configuration may result in the sealed cells providing a pressure on the patient's anatomical feature.

18 Claims, 8 Drawing Sheets

(52) U.S. Cl.
CPC ..... *A61H 2201/165* (2013.01); *A61H 2201/1609* (2013.01); *A61H 2201/1614* (2013.01); *A61H 2201/1619* (2013.01); *A61H 2201/1635* (2013.01); *A61H 2201/1647* (2013.01); *A61H 2201/50* (2013.01); *A61H 2201/501* (2013.01); *A61H 2201/5071* (2013.01); *A61H 2201/5087* (2013.01); *A61H 2201/5097* (2013.01); *A61H 2209/00* (2013.01); *A61H 2230/207* (2013.01); *A61H 2230/30* (2013.01); *A61H 2230/85* (2013.01)

(58) Field of Classification Search
CPC .... A61H 2201/1604; A61H 2201/1635; A61H 2201/50
See application file for complete search history.

(56) References Cited

U.S. PATENT DOCUMENTS 4,086,920 A 5/1978 Miniere
4,338,923 A 7/1982 Gelfer et al.
4,424,806 A 1/1984 Newman et al.
4,762,121 A 8/1988 Shienfeld
4,773,397 A 9/1988 Wright et al.
4,865,020 A 9/1989 Bullard
4,922,893 A 5/1990 Wright et al.
5,014,681 A * 5/1991 Heeman ..... A61H 9/0078 128/DIG. 20
5,092,317 A 3/1992 Zelikovski
5,117,812 A 6/1992 McWhorter
5,179,941 A 1/1993 Siemssen et al.
5,186,163 A 2/1993 Dye
5,263,473 A 11/1993 McWhorter
5,307,791 A 5/1994 Senoue et al.
5,383,842 A 1/1995 Bertini
5,437,610 A 8/1995 Cariapa et al.
5,496,262 A 3/1996 Johnson, Jr. et al.
5,554,103 A 9/1996 Zheng et al.
5,571,075 A 11/1996 Bullard
5,575,762 A 11/1996 Peeler et al.
5,584,798 A 12/1996 Fox
5,588,955 A 12/1996 Johnson, Jr. et al.
5,591,200 A 1/1997 Cone et al.
5,795,312 A 8/1998 Dye
5,830,164 A 11/1998 Cone et al.
5,840,049 A 11/1998 Tumey et al.
5,843,007 A 12/1998 McEwen et al.
5,891,065 A 4/1999 Cariapa et al.
5,951,502 A 9/1999 Peeler et al.
5,968,073 A 10/1999 Jacobs
6,007,559 A 12/1999 Arkans
6,010,471 A 1/2000 Ben-Noon
6,080,120 A 6/2000 Sandman et al.
6,123,681 A 9/2000 Brown, III
6,129,688 A 10/2000 Arkans
6,135,116 A 10/2000 Vogel et al.
6,179,796 B1 * 1/2001 Waldridge ..... A61H 9/0078 601/149
6,231,532 B1 5/2001 Watson et al.
6,234,532 B1 5/2001 Watson et al.
6,290,662 B1 9/2001 Morris et al.
6,296,617 B1 10/2001 Peeler et al.
6,315,745 B1 11/2001 Kloecker
6,406,445 B1 6/2002 Ben-Nun
6,436,064 B1 8/2002 Kloecker
6,440,093 B1 8/2002 McEwen et al.
6,494,852 B1 12/2002 Barak et al.
6,558,338 B1 5/2003 Wasserman
6,585,669 B2 7/2003 Manor et al.
6,645,165 B2 11/2003 Waldridge et al.
6,736,787 B1 5/2004 McEwen et al.
6,786,879 B1 9/2004 Bolam et al.
6,846,295 B1 1/2005 Ben-Nun
6,852,089 B2 2/2005 Kloecker et al.
6,860,862 B2 3/2005 Waldridge et al.
6,884,255 B1 4/2005 Newton
6,893,409 B1 5/2005 Lina
6,945,944 B2 9/2005 Kuiper et al.
6,966,884 B2 11/2005 Waldridge et al.
7,048,702 B2 5/2006 Hui
7,074,200 B1 7/2006 Lewis
7,063,676 B2 8/2006 Barak et al.
7,398,803 B2 7/2008 Newton
7,637,879 B2 12/2009 Barak et al.
7,846,114 B2 12/2010 Webster et al.
7,862,525 B2 1/2011 Carkner et al.
8,095,994 B2 * 1/2012 Natonson ..... A61H 9/0078 2/102
8,182,437 B2 5/2012 Gasbarro et al.
8,202,236 B2 6/2012 Gasbarro
8,376,977 B2 * 2/2013 Farrow ..... A61F 13/08 602/60
9,084,713 B2 * 7/2015 Brown ..... A61H 9/0078
2002/0091345 A1 7/2002 Hazard
2003/0208465 A1 11/2003 Yurko et al.
2004/0059274 A1 3/2004 Kloecker et al.
2004/0171971 A1 9/2004 Ravikumar et al.
2004/0261182 A1 12/2004 Biggie et al.
2005/0154336 A1 7/2005 Kloecker et al.
2005/0222526 A1 10/2005 Perry et al.
2006/0161081 A1 7/2006 Barak et al.
2006/0272719 A1 12/2006 Steinberg
2007/0049853 A1 3/2007 Adams et al.
2007/0088239 A1 4/2007 Roth et al.
2007/0249976 A1 10/2007 Tucker et al.
2007/0272250 A1 11/2007 Lewis
2008/0281240 A1 11/2008 Wright et al.
2009/0007341 A1 1/2009 Roff et al.
2009/0056020 A1 3/2009 Caminade et al.
2009/0145234 A1 6/2009 Gasbarro et al.
2012/0065561 A1 3/2012 Ballas et al.
2012/0219432 A1 8/2012 Wright et al.
2012/0277636 A1 11/2012 Blondheim et al.
2013/0237889 A1 9/2013 Wright et al.
2013/0331748 A1 12/2013 Wright et al.
2014/0052028 A1 2/2014 Wright et al.
2015/0150717 A1 * 6/2015 Lowe ..... A61F 7/02 601/151
2015/0150746 A1 6/2015 Yurko et al.
2015/0224012 A1 8/2015 Wright et al.

FOREIGN PATENT DOCUMENTS

GB 2313784 A 10/1997
WO WO 2005/082314 A1 9/2005
WO WO 2007/074451 A2 7/2007
WO WO 2009/076269 A2 6/2009
WO WO 2013/138307 A1 9/2013
WO WO 2014/031409 A1 2/2014
WO WO 2015/084312 A1 6/2015

* cited by examiner

FIG. 2A
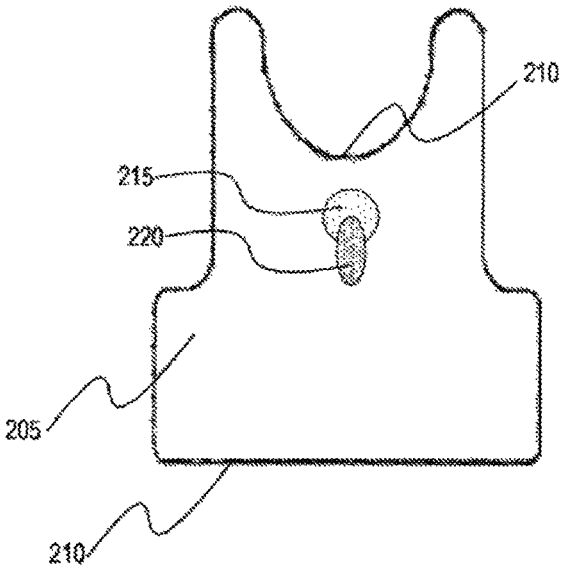
FIG. 2B
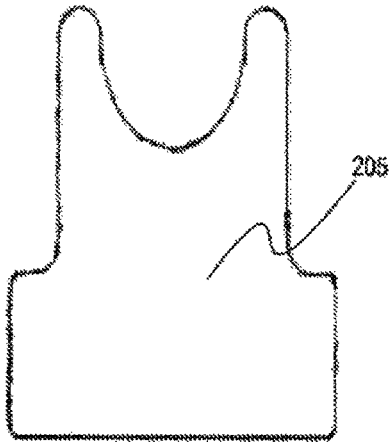
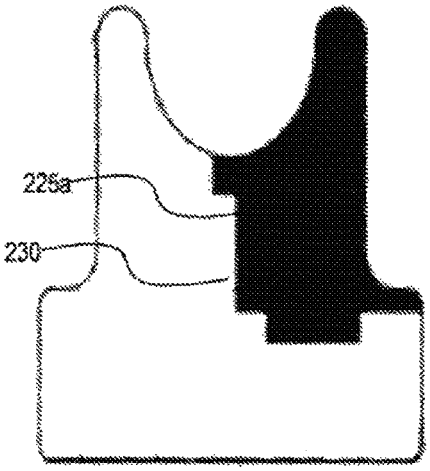
FIG. 2C
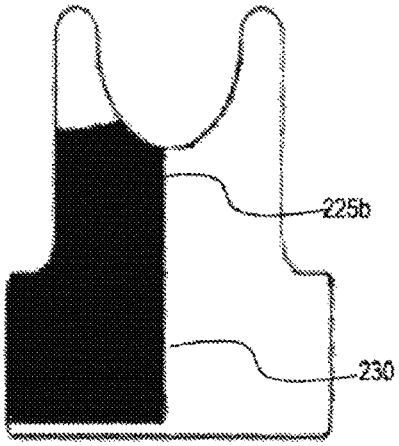
FIG. 2D

BESPOKE COMPRESSION THERAPY DEVICE

CLAIM OF PRIORITY

This application claims benefit of and priority to U.S. Provisional Application No. 61/929,217 filed Jan. 20, 2014, entitled "Bespoke Compression Therapy Device," the disclosure of which is incorporated by reference herein in its entirety.

BACKGROUND

Diseases such as venous insufficiency and lymphedema can result in the pooling of bodily fluids in various anatomical areas. Venous insufficiency occurs when the superficial veins of an extremity empty into the deep veins for example in the lower leg. Normally, the contractions of the calf muscles act as a pump, moving blood into the popliteal vein, the outflow vessel. Failure of this pumping action can occur as a result of muscle weakness, overall chamber size reduction, valvular incompetence, and/or outflow obstruction. Each of these conditions can lead to venous stasis and hypertension in the affected area. Lymphedema, which is swelling due to a blockage of the lymph passages, may be caused by lymphatic obstruction, a blockage of the lymph vessels that drain fluid from tissues throughout the body. This may be due to cancer surgery, general surgery, tumors, radiation treatments, trauma, and congenital anomalies. Lymphedema is a chronic condition that currently has no cure. Other painful, debilitating, and potentially life threatening disorders that cause fluid accumulation may include soft tissue injuries, peripheral arterial disease, and deep vein thrombosis.

Fluid accumulation can be painful and debilitating if it is not treated. In addition, fluid accumulation can reduce oxygen transport, interfere with wound healing, provide a medium that supports infections, or even result in the loss of a limb if left untreated.

Compression therapy has been useful in treating various disorders and reducing fluid accumulation by applying pressure to one or more portions of a patient's body. For example, compression therapy may include moving the accumulated bodily fluids. Compression therapy may generally involve the use of one or more pumps that provide a fluid to an appliance such as a sleeve, a vest, a jacket, or a boot containing one or more separately inflatable cells, which is fitted over a problem area (such as an extremity or the torso of a patient).

However, some appliances do not provide an adequate fit to the anatomical area in need of compression. In addition, the appliance may provide compression to other areas of the patient's body where compression may not be desired, thereby potentially hindering desired patient movement.

SUMMARY

In an embodiment, a bespoke compression therapy device may include a wearable article composed of a template article having a first exterior surface, a second exterior surface, and a plurality of binding seams at one or more edges of the template article configured to secure the first exterior surface to the second exterior surface, in which the template article is modified to include a plurality of cells, each of the plurality of cells being delimited by at least one cell boundary seal, in which each of the plurality of cells is configured to independently receive and emit an inflation fluid, and the at least one cell boundary seal is fabricated in accordance with a measurement of an anatomical characteristic of a user of the bespoke compression therapy device. Additionally, at least one of the plurality of cells is localized in the wearable article in accordance with the anatomical characteristic of the user of the bespoke compression therapy device. The bespoke compression therapy device may also comprise one or more valve ports, in which each of the one or more valve ports is configured to receive a valve, in which the valve received by each of the one or more valve ports is configured to control a flow of the inflation fluid into and out of at least one of the plurality of cells.

In another embodiment, a method of providing a bespoke compression therapy device to a patient may include measuring at least one anatomical area on the patient where compression is desired thereby obtaining at least one measurement, providing the at least one measurement to a provider of the bespoke compression therapy device, receiving, from the provider, the bespoke compression therapy device comprising a template article modified to incorporate a plurality of sealed cells, in which at least one of the plurality of sealed cells is configured so that, when inflated, the sealed cell corresponds to the at least one measurement, placing the bespoke compression therapy device on the patient, and inflating the at least one sealed cell.

In another embodiment, a method of manufacturing a bespoke compression therapy device may include providing a template article that is configured to generally correspond to at least one anatomical feature of one or more patients, in which the template article is configured to be modified to incorporate one or more sealed cells, receiving a measurement of at least one target anatomical feature of a patient, determining a configuration of one or more cell boundary seals to be incorporated into the template article, in which the one or more cell boundary seals defines one or more locations of the one or more sealed cells, and in which the one or more sealed cells are localized to provide a pressure to the at least one target anatomical feature. Further, the method may include incorporating the one or more cell boundary seals into the template article, thereby creating the sealed cells according to the determination, and forming, thereby, the bespoke compression therapy device.

BRIEF DESCRIPTION OF THE DRAWINGS

FIGS. 2A and 2B depict a ventral and dorsal view, respectively, of an illustrative template article according to various embodiments.

FIGS. 2C and 2D depict a ventral and dorsal view, respectively, of an illustrative bespoke compression therapy device according to various embodiments.

DETAILED DESCRIPTION

Figure 1:
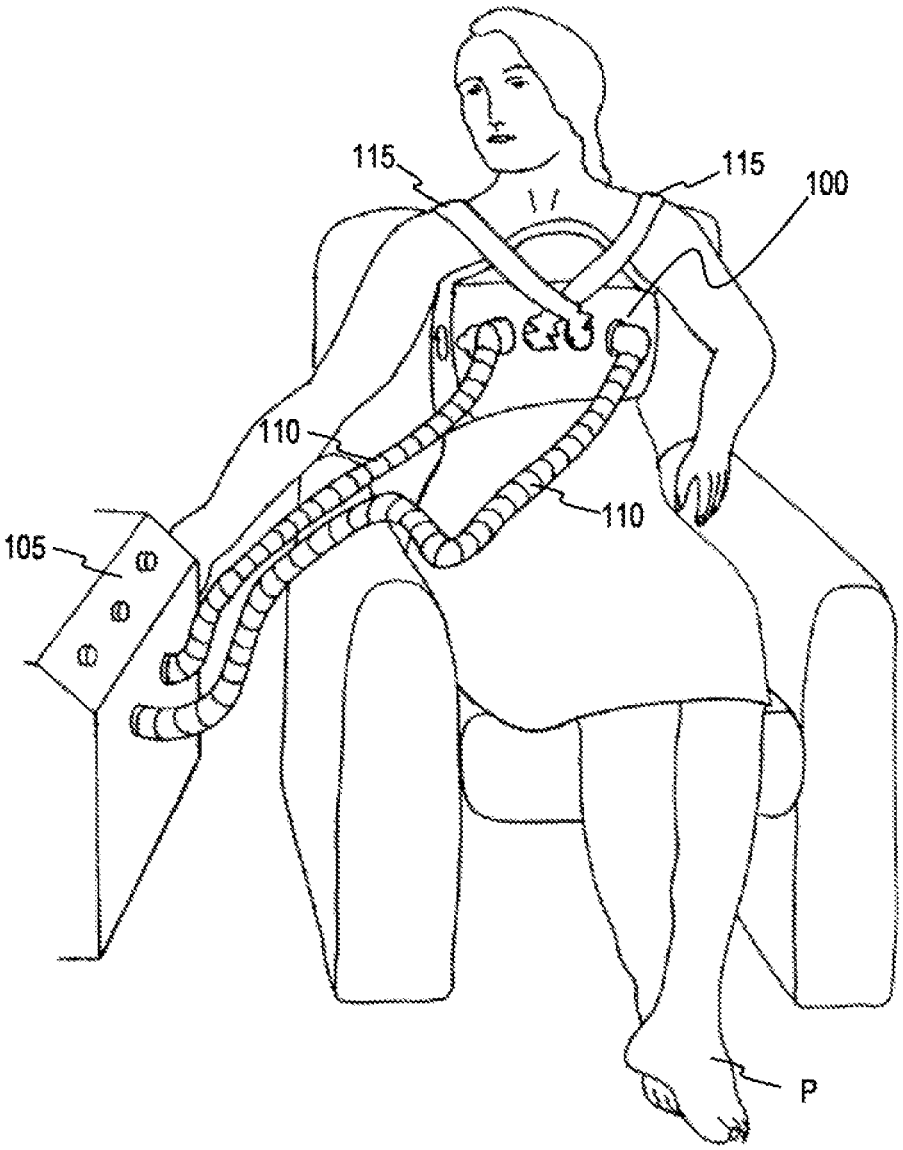
FIG. 1 depicts a patient wearing an illustrative compression device according to an embodiment.

This disclosure is not limited to the particular systems, devices, and methods described, as these may vary. The terminology used in the description is for the purpose of describing the particular versions or embodiments only, and is not intended to limit the scope.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention. As used in this document, the term "comprising" means "including, but not limited to."

The following terms shall have, for the purposes of this application, the respective meanings set forth below.

As used herein, a "compression therapy device" is generally a device that provides pressure to at least a portion of a patient's body. The compression device may be worn by the patient, placed adjacent to the patient, or attached to the patient. The compression device generally contains one or more inflatable cells that, when inflated, provide the pressure to the portion of the patient's body.

As used herein, a "cell" is generally a sealed device configured to inflate and deflate. Those with ordinary skill in the art will recognize that the cell may generally be any compartment, bladder, bubble, and/or the like, as well as various portions thereof, that is configured to retain a fluid therein. The cell can include one or more valves or valve systems for inserting and/or removing the fluid from the cell. The cell may generally have any type of construction and may be made of any material, as described in greater detail herein. The cell may be configured to be a particular shape and/or size, as described in greater detail herein.

As used herein, a "template article" is generally a pre-manufactured wearable garment having a first exterior surface, a second exterior surface, and a plurality of binding seams at the edges of the template article to secure the first exterior surface to the second exterior surface, thereby forming at least one space therebetween. The template article may be configured to receive or emit an inflation fluid into or from the at least one space between the first exterior surface and the second exterior surface. The template article may take the form of any wearable garment including, but not limited to, a hat, a sleeve, a glove, a jacket, a vest, long pants, short pants, legging, a shoe, or a boot. The template article may be manufactured in any number of sizes, such sizes corresponding to sizes found in typical wearable garments. In some non-limiting examples, such sizes may include "extra small," "small," "medium," "large," and "extra-large." Alternatively, such sizes may correspond to physical dimensions of anatomical areas of a patient, non-limiting examples being a waist size, a hip size, an inseam size, a chest size, a bust size, a neck size, a foot size, and a head size. Additionally, such sizes may correspond to one or more size metrics as used in garment manufacture. The template article may be modified for patient-specific use by the introduction of one or more cell boundary seals between the first exterior surface and the second exterior surface within the article, thereby forming one or more independently inflatable cells within the at least one space between the first exterior surface and the second exterior surface. Such a modified template article may be used to form a bespoke compression therapy device.

As used herein, the term "open," when referring to a valve or valve system, may be defined as a state of the valve or valve system in which a structure associated with a first side of the valve is placed in fluid communication with a structure associated with a second side of the valve.

As used herein, the term "closed," when referring to a valve or valve system, may be defined as a state of the valve or valve system in which a structure associated with a first side of the valve is not placed in fluid communication with a structure associated with a second side of the valve.

As disclosed above, compression therapy may be used to treat disorders related to fluid accumulation in tissue by the application of pressure to one or more portions of a patient's body. Compression therapy may generally involve the use of one or more pumps to provide an inflation fluid to an appliance, such as a sleeve, a vest, a jacket, or a boot containing one or more separately inflatable cells, in which the appliance is fitted over the portion of the patient's anatomy where fluid accumulation has occurred.

The effectiveness of the compression therapy may depend at least in part on the proper localization of the one or more inflatable cells with respect to the tissue requiring treatment. Tissues that may benefit from compression therapy may be located in any portion of a patient's anatomy depending on the underlying pathology or the results of surgical interventions. Further, it may be well appreciated that the anatomy of patients requiring compression therapy may vary widely in terms of limb or torso length, and circumference of patient body parts (such as calf, thigh, waist, or bust circumferences).

An "off-the-shelf" compression therapy appliance may be readily and inexpensively mass-produced in a limited number of sizes. However, such limited-sized devices may not be effective to assist patients who have anatomical dimensions between the manufactured sizes. Additionally, such "off-the-shelf" compression therapy appliances may not be capable of applying adequate pressure to the specific tissues in need of compression for a given patient.

Alternatively, a "made-to-measure" compression therapy appliance may be custom tailored to the specific anatomical measurements of a patient, and the compression cells may be specifically localized according to therapeutic need. However, the fabrication of a "made-to-measure" compression therapy appliance may be time consuming, with fabrication being delayed until all of the relevant anatomical measurements have been received by the manufacturer. Also, from the perspective of a manufacturer, such "made-to-measure" compression therapy appliances may prove costly as each appliance would be manufactured as a "one-off" device.

The present disclosure relates generally to a compression therapy appliance (herein referred to as a "bespoke compression therapy device") manufactured in a manner that incorporates the benefits of, but avoids the disadvantages of, each of an "off-the-shelf" device and a "made-to-measure" device. The "bespoke compression therapy device" may be fabricated from a template article having the general shape of a wearable article. The template article, similar to the "off-the-shelf" device, may be mass-produced in a limited number of sizes. The template article may be designed so that the interior space between the two exterior surfaces may be readily modified to incorporate any number or position of internal cell boundary seals, thereby dividing the interior space into one or more individually inflatable/deflatable cells. The number and/or placement of such internal cell boundary seals may be determined based on patient specific measurements or therapeutic requirements, similar to the fabrication of a "made-to-measure" device. The internal cell boundary seals may be easily fabricated. Thus, the production of the final bespoke device by modification of mass produced template articles may require less time and/or cost to manufacture than the production of a "made-to-measure" device.

FIG. 1 depicts a patient P wearing a compression device 100 according to an embodiment. As shown in FIG. 1, the compression device 100 may contain various components, such as, for example, a pump 105, one or more tubes 110, and/or one or more retention devices 115. In some embodiments, all elements of the compression device 100 may be integrated into a single device. In other embodiments, such as the embodiment depicted in FIG. 1, various elements may be external to the compression device 100, such as the pump 105 and/or the one or more tubes 110.

The pump 105 may be any device configured to insert or remove an inflation fluid from one or more cells, as described in greater detail herein. More particularly, the pump 105 may include, without limitation, a pressurization/pressure device, vacuum device, or any other suitable means for generating fluid flow. In particular embodiments, the pump 105 may create a gradient such that a fluid is driven into the one or more cells or such that a fluid is driven from the one or more cells.

In one non-limiting embodiment, the pump 105 may be configured to provide any amount of fluid over any period of time to and/or from the one or more cells. For example, the pump may provide the fluid at a rate of about 0.1 μL/minute to about 10 L/minute, including about 0.1 μL/minute, about 1 μL/minute, about 10 μL/minute, about 100 μL/minute, about 1 mL/minute, about 10 mL/minute, about 100 mL/minute, about 1 L/minute, about 10 L/minute, or any value or range between any two of these values (including endpoints). In some embodiments, the pump 105 may be a nanoflow pump that is configured to provide nanoliter-per-minute flows. In other embodiments, the pump 105 may be a microflow pump that is configured to provide microliter-per-minute flows.

In another non-limiting embodiment, the fluid outflow from the pump 105 may be regulated with respect to the pressure attained by the one or more cells upon receipt of the fluid. Thus, the pump 105 may be configured to inflate one or more cells to a pressure greater than 0 mmHg (0 Pa) and less than or equal to about 100 mmHg (13.3 kPa). Non-limiting examples of a cell pressure may include about 0.1 mmHg (13.3 Pa), about 10 mmHg (1.33 KPa), about 20 mmHg (2.67 kPa), about 30 mmHg (4.0 kPa), about 40 mmHg (5.33 kPa), about 50 mmHg (6.67 kPa), about 60 mmHg (8.0 kPa), about 70 mmHg (9.33 kPa), about 80 mmHg (10.7 kPa), about 90 mmHg (12.0 kPa), about 100 mmHg (13.3 kPa), or any value or range between any two of the values (including endpoints). It may be recognized that such values are examples only, and that the one or more cells may attain pressures in excess of 100 mmHg (13.3 kPa) due to the action of the pump 105 depending on the requirements of the compression therapy or pathology treated by the compression therapy.

The one or more tubes 110 may generally be any tubes that are constructed to provide fluid between the pump 105 and at least one portion of the compression device 100. Thus, the one or more tubes 110 may generally be configured to withstand a pressure of the fluid transferred between the pump 105 and the at least one portion of the compression device 100. The tubes 110 may be of any length, particularly lengths that are suitable to provide a fluid communication between the pump 105 and the at least one portion of the compression device 100. Similarly, the tubes 110 may have any diameter, particularly diameters that are suitable to provide a fluid communication between the pump 105 and the at least one portion of the compression device 100. In some non-limiting embodiments, the tubes 110 may also have a diameter specifically adapted to regulate or limit a fluid flow therethrough or fluid pressure therein. Those with ordinary skill in the art will recognize that the one or more tubes 110 may be constructed of any suitable material for purposes described herein, including, for example and without limitation, one or more polymers, glass, rubber, and/or the like.

The one or more retention devices 115 may generally be any devices that hold a portion of the compression device 100 adjacent to the patient P. For example, the one or more retention devices 115 may ensure that the compression device 100 is properly positioned with respect to the patient P. The one or more retention devices 115 are not limited by this disclosure and may include, for example and without limitation, arms, straps, sleeves, wraps, adhesive components, buttons, snaps, hook and loop retention systems, and/or the like. In some embodiments, the one or more retention devices 115 may not be included as part of the compression device 100 because the pressure provided by the compression device 100 may act to keep the compression device 100 in proper alignment with the patient P.

It may be understood that the system depicted in FIG. 1 is intended to generally illustrate a compression therapy system including a compression device 100, and the additional components used therewith to provide compression therapy to a patient. No limitations should be inferred from FIG. 1 regarding the sizes, shapes, positions, locations, or relative connectivity of the components of the system.

The bespoke compression therapy device may be fabricated from one or more modifications of a template article having the general shape of a wearable garment. FIGS. 2A and 2B depict illustrative template articles according to various embodiments. For example, as shown in FIGS. 2A and 2B, the template article may be a vest-like garment that is worn by the patient. FIG. 2A illustrates a ventral view of such an article, while FIG. 2B illustrates a dorsal view of the article. However, it may be understood that the template article (and the bespoke compression therapy device made as a modification thereof) may resemble other garments such as, for example, a long sleeve shirt, a short sleeve shirt, a girdle, a corset, shorts, pants, leggings, a sleeve, a glove, a boot, and a hat. Those with ordinary skill in the art will recognize that the template article (and the bespoke compression therapy device made as a modification thereof) may resemble other garment-like designs without departing from the scope of the present disclosure.

The template article may be fabricated from a first exterior surface 205 that may face the exterior environment and a second exterior surface (not shown) that may face the body of the user. The first exterior surface 205 and the second exterior surface of the template article may each independently comprise one or more of a material, such as, without limitation, a fabric, a polymer, a polymer-containing material, a urethane, a polymer coated fabric, a urethane coated fabric, a natural rubber, and a synthetic rubber. Thus, the first exterior surface 205 and the second exterior surface of the template article may be composed of the same material. Alternatively, the first exterior surface 205 and the second exterior surface of the template article may be composed of different materials. As a non-limiting example, the first exterior surface 205 may be fabricated of a water-proof polymer or polymer-containing material to protect the template article (or the bespoke compression therapy device made as a modification thereof) from environmental factors such as water. However, the second exterior surface of the template article (or the bespoke compression therapy device made as a modification thereof) may be fabricated from a fabric capable of wicking sweat away from the surface of the user wearing it. It may be appreciated that the bespoke compression therapy device (made as a modification of the template article) may be worn directly against a user's skin, against a user's undergarment, or against a user's regular garment.

The first exterior surface 205 and the second exterior surface of the template article may be secured together by a plurality of binding seams 210 at the edges of the template article. Such a construction may produce at least one space between the first exterior surface 205 and the second exterior surface. The plurality of binding seams 210 may be sufficiently tight so that an inflation fluid may be stably introduced into the space. It may be understood that an inflation fluid stably introduced into a space (of a template article) or a cell (of a bespoke compression therapy device) may not appreciably leak from the space or cell after the fluid is introduced therein.

In some embodiments, the template article may also include one or more valve ports 215. Such valve ports may be fabricated to receive a valve 220. The valve port 215 may be constructed so that it forms a fluid-tight seal against a body of the valve 220. The valve 220 may be configured to permit an inflation fluid to enter the space of the template article or of one or more cells of a bespoke compression therapy device fabricated as a modification thereof. In some embodiments, the template article may include only the one or more valve ports 215. In some other embodiments, the template article may include the one or more valve ports 215 along with each valve port's respective valve 220. In some alternative embodiments, the template article may lack the valve ports 215 and valves 220. In these embodiments, the one or more valve ports 215 along with each of valve port's respective valves 220 may be introduced into the bespoke compression therapy device as a modification of the template article during a later fabrication stage. It may be understood that the term "valve port" as used herein refers to a portion of the template article or bespoke compression therapy device that is configured to receive a valve in such a manner as to prevent fluid leakage at the valve/article (device) interface. The material from which the valve port is made or the manner in which the valve port receives the valve may include any material or manner as may be understood by one with ordinary skill in the art.

As noted above, the bespoke compression therapy device may be fabricated from one or more modifications of a template article. FIGS. 2C and 2D depict illustrative bespoke compression therapy devices according to various embodiments. For example, as shown in FIGS. 2C and 2D, the compression therapy device may be a vest-like garment that is worn by the patient. FIG. 2C illustrates a ventral view of such a device, while FIG. 2D illustrates a dorsal view of the device. The compression therapy device may include one or more cells 225*a,b*. Such cells 225*a,b* may be defined or physically isolated by one or more cell boundary seals 230 introduced in the template device between the first exterior surface 205 and the second exterior surface. The one or more cells 225*a,b* may be shaped and/or formed such that, when inflated, they would not constrict or hinder use of the compression device.

The one or more cell boundary seals 230 may be formed in any pattern or configuration, particularly such that various portions of the template article may be sealed to form a compression therapy device that addresses a specific injury and/or fit an anatomical feature of a patient, as described in greater detail herein. For example, as illustrated in FIG. 2C, a cell 225*a* at a shoulder portion of the compression device may be sealed along a set of cell boundary seals 230 so that it is inflatable and/or deflatable while the remainder of the compression device is not inflated and/or deflated. Similarly, as illustrated in FIG. 2D, a cell 225*b* at a rib portion of the compression therapy device may be sealed along a set of sealable boundaries 230 so that it is inflatable and/or deflatable while the remainder of the compression device is not inflated and/or deflated.

Inflation of the one or more cells 225*a,b* may be accomplished by the introduction of an inflation fluid into the cells. Non-limiting examples of such an inflation fluid may include water, air, nitrogen gas, carbon dioxide gas, or any other liquid or gaseous fluid. Such an inflation fluid may be introduced into the one or more cells 225*a,b* through the valves 215 that penetrate into cells through the valve ports 220. The valves 215 may be used to control a flow of the inflation fluid into and out of the cells. In one non-limiting example, the template article may include one or more valve ports 215 or components configured to be modified into valve ports. In another non-limiting example, the process of modifying the template article into the compression therapy device may also include introducing one or more valve ports 215 and one or more valves 220 into the compression therapy device.

It may be understood that in some embodiments, a template article may include one or more valves 220 that may not be used in the bespoke compression therapy device fabricated as a modification thereof. For example, a template article forming a vest or jacket may include two valves 220 symmetrically placed on a ventral portion to cover a patient's chest (for example, one valve placed over each pectoral muscle). However, compression therapy may be desired only on one portion of the chest, one shoulder, one portion of the back, one arm, or otherwise asymmetrically on the patient. In such an embodiment, an unused valve 220 may be capped or sealed to prevent air or any other fluid from entering the non-therapeutic portion of the bespoke therapy device.

It may be appreciated that additional modifications to the template device may be made as part of the process of fabricating the bespoke compression therapy device therefrom. Such modifications may include, without limitation, the addition of one or more sensors in association with one or more of the cells fabricated from the template article. Such sensors, as further disclosed herein, may provide information to a health care provider regarding the inflation/deflation state of the one or more cells. Non-limiting examples of such sensors may include sensors configured to measure a fluid flow into the one or more cells, a pressure developed within the one or more cells, or a deformation of the surface of the one or more cells.

Because the template article can be arbitrarily modified to form the compression therapy device, the compression therapy device may be fitted specifically for each patient according to the patient's anatomical features, shape, size, and the particular area in need of compression. In some non-limiting examples, such cells may be localized within the compression device to lie proximal to one or more of a patient's foot, ankle, lower leg, knee, upper leg, hip, waist, abdomen, chest, bust, torso, shoulder, neck, head, upper arm, elbow, lower arm, wrist, and hand.

Figure 3A:
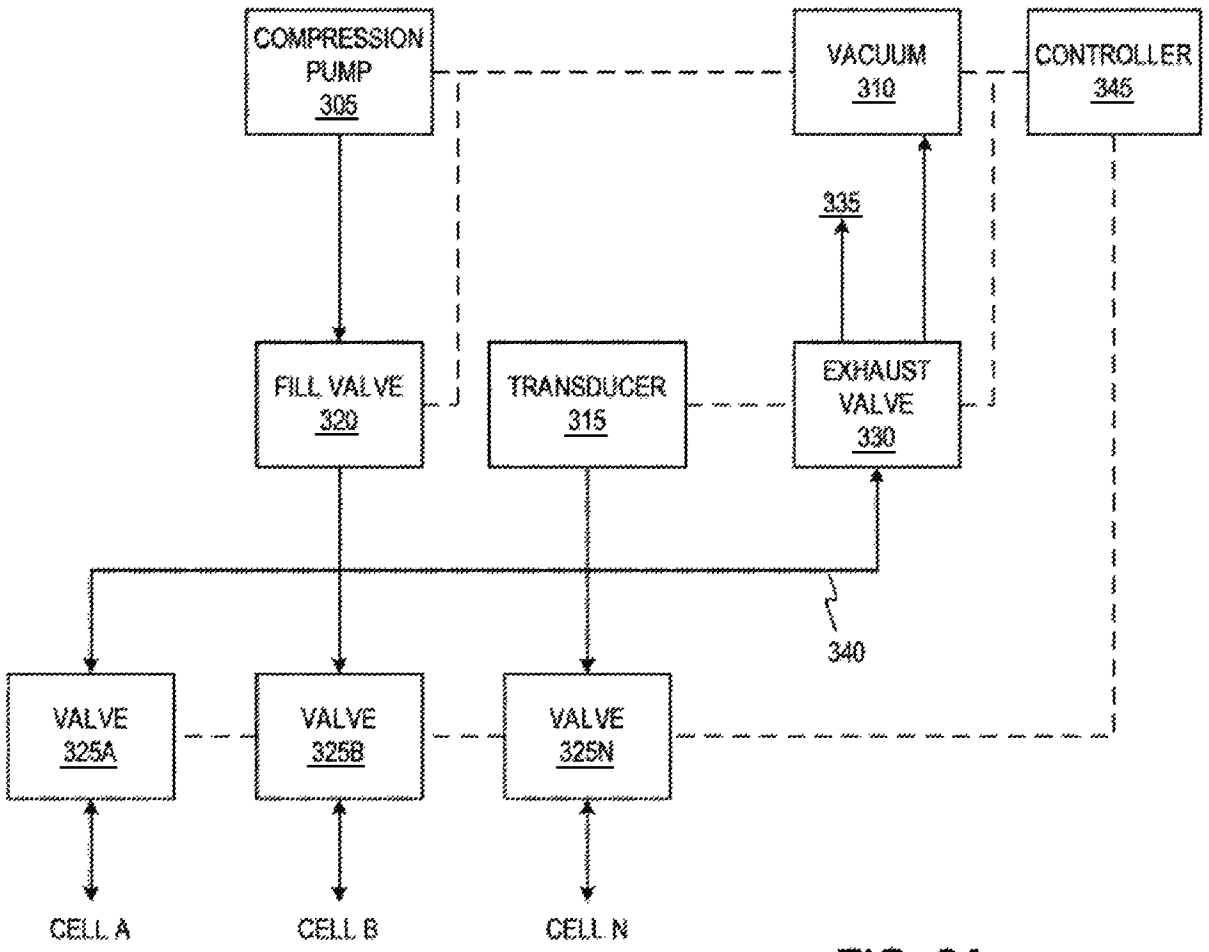
FIG. 3A depicts a block diagram of an illustrative compression device according to an embodiment.
Figure 3B:
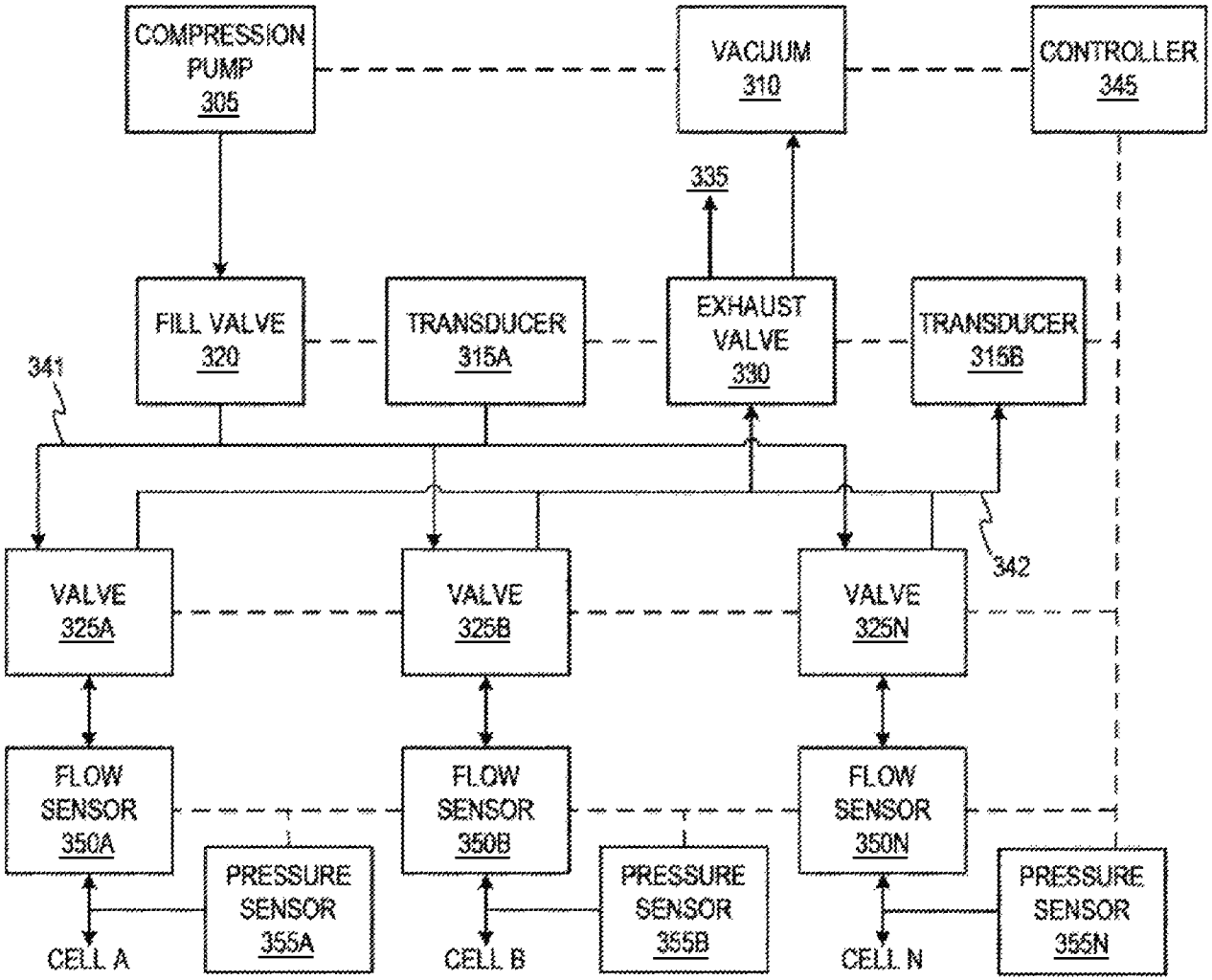
FIG. 3B depicts a block diagram of an alternate illustrative compression device according to an embodiment.

To ensure proper inflation and/or deflation of the various cells, the compression device may incorporate a number of additional elements, as depicted in FIGS. 3A and 3B. As shown in FIG. 3A, the compression device may include at least one pump 305, at least one fill valve 320, a vacuum source 310, at least one exhaust valve 330, a transducer 315, a controller 345 and a plurality of cell valves 325A-N. The pump 305 may be used as to provide a fluid, including, without limitation, air, nitrogen, or water. In some embodiments, the fluid may be pressurized. The fill valve 320 may be in fluid communication with the pump 305 via a pump output to receive the fluid. During an inflation period, the fill valve 320 may be in an open position to connect the output of the pump 305 to a common node or manifold 340. During a deflation period, the exhaust valve 330 may be placed in an open position to connect the common manifold 340 to, for example, a vacuum source 310 to depressurize the cells. Alternatively, the exhaust valve 330 may be connected to the atmosphere 335 and may release the fluid into the atmosphere during the deflation period. It may be understood that the vacuum source 310 and/or the atmosphere 335 may serve as a sink for pressurizing fluid. One or more outputs to the vacuum source 310 or to the atmosphere 335 may be provided. Typically, the fill valve 320 and the exhaust valve 330 are not open at the same time. However, some modes of use of the compression device may benefit from the fill valve 320 and the exhaust valve 330 being open together. Although FIG. 3A illustrates a single exhaust valve 330 capable of connecting to either the vacuum source 310 or the atmosphere 335, it may be appreciated that one exhaust valve may be used to connect the manifold 340 to the vacuum source 310, while a second exhaust valve may be used to connect the manifold 340 to the atmosphere 335. The fill valve 320 and the exhaust valve 330 may be manually operated, or may be automatically operated by the controller 345 (see dotted lines in FIG. 3A). Additional fill and/or exhaust valves may be associated with the manifold 340. Each of the cell valves 325A-N may be connected to the common manifold 340 on a first side and a corresponding cell on a second side. Each cell valve 325A-N may be used to selectively connect (in an open configuration) or disconnect (in a closed configuration) the corresponding cell to the common manifold 340. The vacuum source 310, compression pump 305, one or more exhaust valves 330, fill valve 320, and cell valves 325A-N may all be connected to the controller 345 that may control independently their respective operations (see dotted lines in FIG. 3A). Alternatively, any one or more of the vacuum source 310, compression pump 305, one or more exhaust valves 330, fill valve 320 and cell valves 325A-N may be operated manually.

The transducer 315 may be connected to and used to monitor the pressure of the common manifold 340. Additionally, one or more sensors, such as pressure sensors or flow rate sensors, may be located on the cell side of the valves. The controller 345 may receive information regarding the pressure detected by the transducer 315 or by any other sensor associated with the cell valves 325A-N (see dotted lines in FIG. 3A). Based on at least the received pressure information, the controller 345 may determine whether to open or close the fill valve 320, the exhaust valve 330, and/or one or more of the cell valves 325A-N.

In various embodiments, such as the embodiment illustrated in FIG. 3A, the transducer 315 may have a transfer function associated with it. The transfer function may be used to determine an input pressure monitored at the common manifold 340. For example, the transfer function for an MPX5050 transducer manufactured by Motorola may be $V_O = V_S \times (0.018 \times P + 0.04) + \text{Offset Error}$, where $V_O$ is the output voltage, $V_S$ is the supply voltage (which may be, for example, approximately 5 Volts), P is the input pressure as measured in kPa, and Offset Error is a static voltage value that is dependent on the process, voltage and temperature of the transducer. Solving for the pressure and combining the Offset Error and $0.04V_S$ term results in the following equation:

$$P(\text{kPa}) = \frac{55.6 * (V_O - V_{offset})}{V_S} \tag{1}$$

Equation (1) may also be represented in terms of mm Hg by converting 1 kPa to 7.5 mm Hg. The resulting equation is the following:

$$P(\text{mm Hg}) = \frac{417 * (V_O - V_{offset})}{V_S} \tag{2}$$

The transducer 315 may be calibrated to determine the pressure based on the output voltage. Initially, $V_{offset}$ may be determined by closing all of the cell valves 325A-N and venting the common manifold 340 to the atmosphere 335 via the exhaust valve 330. A value determined by an analog-to-digital (A/D) converter that may either be in communication with or integral to the transducer 315 may be read when the transducer is under atmospheric pressure. The value output by the A/D converter may be an offset value (OFFSET). For a 12-bit A/D converter, OFFSET may be between 0 and 4095.

A scale value (SCALE) may also be determined that corresponds to a scaled source voltage. For example, a precision resistor divide-by-two circuit may be used to divide $V_S$ by 2. The A/D converter may output SCALE based on the $V_S/2$ input value. For a 12-bit A/D converter, SCALE may be a value between 0 and 4095.

Substituting OFFSET and SCALE into Equation (2) results in the following equation:

$$P(\text{mm Hg}) = \frac{208.5 * (\text{TRANSDUCER_OUTPUT} - \text{OFFSET})}{\text{SCALE}} \tag{3}$$

As such, the offset error and the scale error of the transducer 315 and any errors in the transducer supply voltage may be accounted for by measuring the OFFSET and SCALE values once (for example, at power up).

Alternative transducers potentially having different transfer functions may also be used within the scope of the present disclosure, as will be apparent to one of ordinary skill in the art. In addition, one of ordinary skill in the art will recognize that alternate methods of calibrating a transducer may be performed based on the teachings of the present disclosure.

An additional embodiment is illustrated in FIG. 3B. In this embodiment, a fill manifold 341 may be associated with the fill valve 320 and the compression pump 305. A separate exhaust manifold 342 may be associated with the vacuum source 310 and the exhaust valve 330. The cell valves 325A-N may be associated with the fill manifold 341 and the exhaust manifold 342. It is understood that cell valves 325A-N in this embodiment may have a 3-way function: open to fill, open to exhaust, and closed. In some embodiments, each cell may have a first valve to connect to the fill manifold 341 and a second valve to connect to the exhaust manifold 342. In the dual manifold embodiment of FIG. 3B, the transducer 315A, associated with the fill manifold 341, may be calibrated with respect to atmosphere in a manner as disclosed above by means of a separate shunt valve (not shown) associated either directly with the transducer or with the fill manifold. It may be understood that during the calibration process, the fill valve 320 and the cell valves 325A-N may be closed. The exhaust manifold 342 may also be in communication with its own transducer 315B to monitor the pressure within the exhaust manifold. The transducer 315B may be calibrated with respect to atmosphere in a manner similar to that disclosed above with regards to transducer 315A in FIG. 3A. The vacuum source 310, compression pump 305, one or more exhaust valves 330, fill valve 320, and cell valves 325A-N may all be connected to the controller 345 that may control independently their respective operations (see dotted lines in FIG. 3B). Alternatively, any one or more of the vacuum source 310, compression pump 305, one or more exhaust valves 330, fill valve 320 and cell valves 325A-N may be operated manually. The transducers 315A and 315B may provide additional sensor data to the controller 345 (see dotted lines in FIG. 3B).

In addition, each valve 325A-N may be in fluid communication with a flow sensor 350A-N in-line with the connection to its respective cell. Each flow sensor 350A-N may be associated with a valve 325A-N or with an inflatable cell. In some embodiments, the flow sensors 350A-N may be incorporated with the respective valves 325A-N as part of the fabrication of the template article. Alternatively, the flow sensors 350A-N may be associated with the valves 325A-N during the process of modifying the template article into the bespoke compression therapy device. The flow sensors 350A-N may provide sensor data to the controller 345 as well (see dotted lines in FIG. 3B). For example, a flow sensor 350A-N may be used to monitor whether its respective valve 325A-N is completely open. If a valve is blocked or otherwise impeded, the fluid flow through the valve may not match an expected flow profile as determined by the controller 345. A flow sensor 350A-N could provide the controller 345 with data to indicate a fault with the associated valve. The controller 345 may be programmed to notify a user of the valve flow fault condition. Additionally, the flow sensors 350A-N may be used to accurately determine the fill/exhaust time for a cell. Based on the data from the flow sensor, the fill/exhaust rate for a cell may be adjusted by the controller 345 to control the amount of time required for a fill or exhaust step. A clinician developing a particular therapy protocol may then be able to program a fill or exhaust time as part of the protocol. Such time-based programming may be easier for a clinician to use instead of flow rates and volumes.

In addition, the volume of a cell and the fill rate from the flow sensor may enable the controller 345 to detect the presence or absence of an anatomical area, and/or calculate the volume or size of the anatomical area and factor the shape and/or configuration of the cells as described in greater detail herein. In one embodiment, a measurement of anatomical area size may be used by the controller 345 for compliance monitoring. In another embodiment, such data may also be used as input to an algorithm for making the compression device more adaptive for different anatomical area sizes.

Additionally, a pressure sensor 355A-N may be associated with each cell to measure the fluid pressure within the cell during its operation. Alternatively, each pressure sensor 355A-N may be associated with a respective cell valve 325A . . . N. In some embodiments, the pressure sensors 355A-N may each be associated with a cell or incorporated with a respective valve 325A-N as part of the fabrication of the template article. Alternatively, such pressure sensors 355A-N may be associated with the cells or with the valves 325A-N during the process of modifying the template article into the bespoke compression therapy device. The pressure sensors 355A-N may also provide data to the controller 345 so that the controller 345 may be able to control the operation of the compression device (see dotted lines, FIG. 3B). A pressure sensor 355A-N associated with its respective cell, may provide a direct indication of a pressurization or depressurization profile of the cell. The controller 345 may compare an individual cell pressure against a preprogrammed cell pressure profile. If a cell is unable to sustain an expected pressure, a leak condition may be determined. The controller 345 may be programmed to notify a user of the leak condition.

Although FIG. 3A does not explicitly illustrate the use of either flow or pressure sensors between the valves 325A-N and their respective cells, it may be appreciated that flow sensors and/or pressure sensors may be included in alternate embodiments. Similarly, although FIG. 3B illustrates the use of such sensors, it should be understood that other embodiments may lack one or both types of sensors.

Additional features may be associated with the cells, including, without limitation, volume sensors, inflation sensors, and additional valves. FIGS. 4A-4D illustrate embodiments of the cells that may be integrated with the compression device.

Figure 4A:
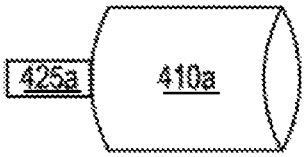
FIGS. 4A-4D depict illustrative cells according to various embodiments.

In one embodiment, illustrated in FIG. 4A, an inflatable cell 410*a* may be in fluid communication with its cell valve 425*a*. The cell valve 425*a* may be in fluid communication with the manifold 340 (FIG. 3A) or both the fill manifold 341 and the exhaust manifold 342 (FIG. 3B).

Figure 4B:
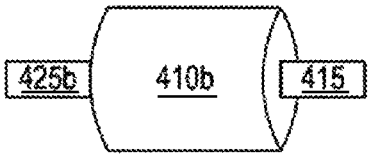

In another embodiment, illustrated in FIG. 4B, the cell 410*b* may have a cell valve 425*b* in fluid communication with the manifold 340 (FIG. 3A) or manifolds 341, 342 (FIG. 3B). In addition, the cell 410*b* may have a shunt valve 415 which may be vented to the atmosphere. For example, the valve 415 may be used as an emergency release valve in the event that the cell 410*b* is unable to be exhausted by the valve 425 and/or the exhaust valve 330. The valve 415 may be manually operated or automatically operated under control of controller 345 (FIG. 3A). In one non-limiting embodiment, such a shunt valve 415 may be incorporated into a cell 410*b* of the bespoke compression therapy device upon its fabrication (that is, during the modification of the template article to form the therapy device).

Figure 4C:
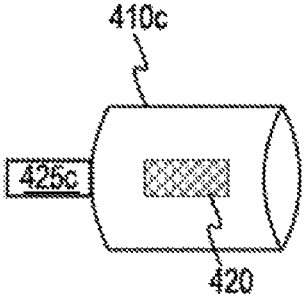

As illustrated in FIG. 4C, a cell 410*c* may have a cell valve 425*c* and may also have a strain gauge 420 associated with the cell material. The strain gauge 420 may be glued or otherwise affixed to the cell 410*c* or fabricated as part of the cell, and may be associated with either an inner or an outer surface of the cell. In one embodiment, such a strain gauge 420 may be associated with one or more cells 410*c* of a bespoke compression therapy device during fabrication of the therapy device as part of the modification of the template article. The strain gauge 420 may be used to measure the deformation of the cell material as it is inflated or deflated, and thereby provide a measure of the volume of fluid within the cell 410*c*. Although a single strain gauge 420 is illustrated, it may be appreciated that multiple strain gauges 420 may be associated with each cell 410*c* to provide accurate data regarding the change in volume or shape of the cell during a therapeutic cycle.

Figure 4D:
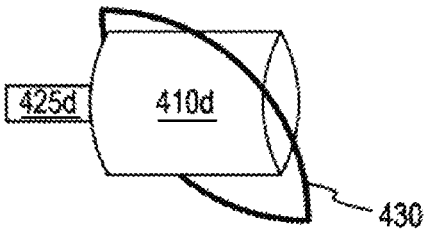

In another embodiment, illustrated in FIG. 4D, the cell 410*d* may be in fluid communication with the valve 425*d*, thereby permitting the cell to have fluid access to the fill and/or exhaust manifold. The cell 410*d* may be fitted with a plethysmograph sensor 430 that may also be used to detect changes in cell shape (such as cell material deformation) or volume during a therapeutic cycle. Multiple plethysmograph sensors 430 may be associated with each cell 410*d* for improved data collection. The one or more plethysmograph sensors 430 may be associated with the more of more cells 410*d* of the bespoke compression therapy device during its manufacture from a template device.

The strain gauge 420 and the plethysmograph sensor 430 may communicate with the controller 345, thereby providing a point of control feedback to the controller. Although the strain gauge 420 and the plethysmograph sensor 430 are illustrated in FIGS. 4C and 4D, it may be understood that they represent non-limiting examples of sensor systems capable of determining the change in cell shape and/or volume.

It may be understood that additional components, such as shunt valves 415, strain gauges 420, and plethysmograph sensors 430, may be associated with the one or more cells of the bespoke compression therapy device as part of the modifications introduced to the template article during the fabrication of the compression therapy device.

A compression device may be operated to provide a variety of therapeutic protocols. A therapeutic protocol may be defined as a specific sequence of operations to inflate (fill) and deflate (exhaust) one or more cells while they are in contact with a patient. Therapeutic protocols may include, in a non-limiting example, a list of an ordered sequence of cells to be activated, an inflation or deflation pressure threshold value for each cell, an amount of time during cell inflation or deflation, and a phase or lag time between sequential cell activation. In one non-limiting example, the therapeutic protocol may result in the inflation of a plurality of cells substantially simultaneously. In an alternative non-limiting embodiment, the therapeutic protocol may result in the inflation of a plurality of cells in an ordered sequence. It may be understood that an ordered sequence of cells is a sequence of cell inflation over time. In one non-limiting example, the sequentially inflated cells may be physically contiguous in the compression sleeve. In another non-limiting example, the sequentially inflated cells may not be physically contiguous, but may be located in physically separated parts of the compression device.

In an additional non-limiting example, the therapeutic protocol may result in stopping the inflation of a plurality of cells substantially simultaneously. In an additional non-limiting example, the therapeutic protocol may result in stopping the inflation of a plurality of cells in an ordered sequence. In some non-limiting examples of a therapeutic protocol, each of a plurality of cells may retain fluid at about the same cell pressure. In some non-limiting examples of a therapeutic protocol, each of a plurality of cells may retain fluid at different cell pressures.

A further non-limiting example of the therapeutic protocol may include deflating a plurality of cells substantially simultaneously. A further non-limiting example of the therapeutic protocol may include deflating a plurality of cells in an ordered sequence. It may be understood that an ordered sequence of cells is a sequence of cell deflation over time. In one non-limiting example, the sequentially deflated cells may be physically contiguous in the compression device. In another non-limiting example, the sequentially deflated cells may not be physically contiguous, but may be located in physically separated parts of the compression device.

In yet another non-limiting example of a therapeutic protocol, one of the cells may be inflated and a second cell may be deflated during at least some period of time. As one non-limiting example, one or more cells may be inflated simultaneously as one or more cells are deflated. In another non-limiting example, a first one or more cells may begin inflation and a second one or more cells may begin deflation after the first one or more cells have started inflating. In an alternative non-limiting example, a first one or more cells may begin deflation and a second one or more cells may begin inflation after the first one or more cells have started deflating.

Figure 5:
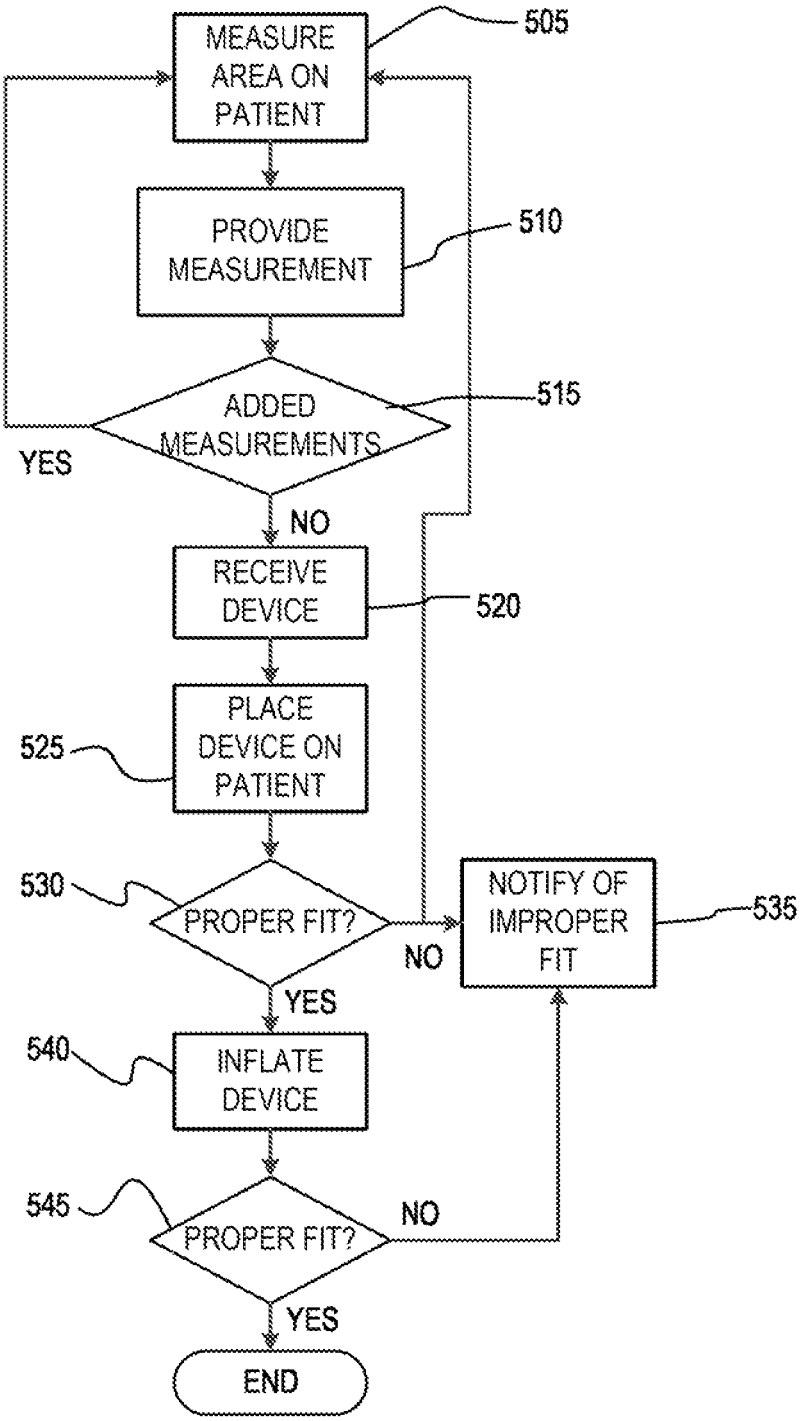
FIG. 5 depicts a flow diagram of an illustrative method of providing a compression device to a patient according to an embodiment.

FIG. 5 depicts a flow diagram of a method of providing a compression device to a patient according to an embodiment. The method may include measuring 505 an area on a patient. Measuring 505 may generally include obtaining various metrics of anatomical areas of the patient, particularly areas where compression is desired, surrounding areas, and/or other areas where at least a portion of the compression device may be located (e.g., shoulders for shoulder straps to hold the compression device in place). Non-limiting examples of such measurements may include one or more of a foot size, an ankle circumference, a calf circumference, a lower leg length, a knee circumference, a thigh circumference, an upper leg length, a hip circumference, a waist circumference, an abdomen circumference, a chest circumference, a bust size, a torso length, a shoulder circumference, a neck circumference, a head circumference, an upper arm circumference, an upper arm length, an elbow circumference, a lower arm length, a lower arm circumference, a wrist circumference, and a hand size.

Measuring 505 may be completed by any method of measuring now known or later developed. In some embodiments, measuring 505 may be manually completed by a healthcare provider, such as a physician, a physician's assistant, a nurse, a nurse practitioner, an occupational therapist, an occupational therapy assistant, a physical therapist, and/or the like. In some embodiments, measuring 505 may be manually completed by a person other than a healthcare provider. In some embodiments, measuring 505 may be completed by an automated device and/or process, such as a laser-based measurement device.

In various embodiments, the measurement may be provided 510 to one or more of a manufacturer of the bespoke compression therapy device, a representative of a manufacturer of the bespoke compression therapy device, and a compression therapy service provider. In embodiments where a representative of the manufacturer and/or compression device provider completes the measuring 505, the providing 510 operation may be omitted. A determination 515 may be made as to whether additional measurements are necessary. Such a determination 515 may be dependent upon, for example, whether an accurate measurement was provided 510 or whether a sufficient number of measurements was provided 510 to prepare the compression device. If the determination 515 is made that additional measurements are needed, the area on the patient may be measured 505 one or more additional times.

Once all measurements for the compression device have been received, the patient, the patient's healthcare provider, or the like may receive 520 in return the compression device. The compression device may be placed 525 on or adjacent to the patient, and a determination 530 may be made regarding the fitness of the device. One determination 530 of fitness may include a determination as to whether the device fits (that is, is tailored) properly. The determination 530 may include ensuring that the device fits over or adjacent to the anatomical areas, that the various cells are properly sealed and arranged, and/or the like. If the device does not fit properly, a notification 535 may be provided to the device manufacturer and/or a device provider, and the process may start over by re-measuring 505 the area on the patient. If the device does fit, it may be inflated 540 as described herein. A second determination 545 as to whether the device fits properly may be completed. The second determination 545 may generally include ensuring that the inflated device fits over or adjacent to the anatomical areas, that the various inflated and deflated cells are properly sealed and arranged, and/or the like. Proper sealing may be include the ability of the seals to stably receive or emit the inflation fluid and not leak. A determination of proper sealing may be included in the determination of overall fitness of the device. If the inflated device does not meet the fitness requirements, a notification 535 may be provided to the device manufacturer and/or the device provider and the process may start over by re-measuring 505 the area on the patient.

Figure 6:
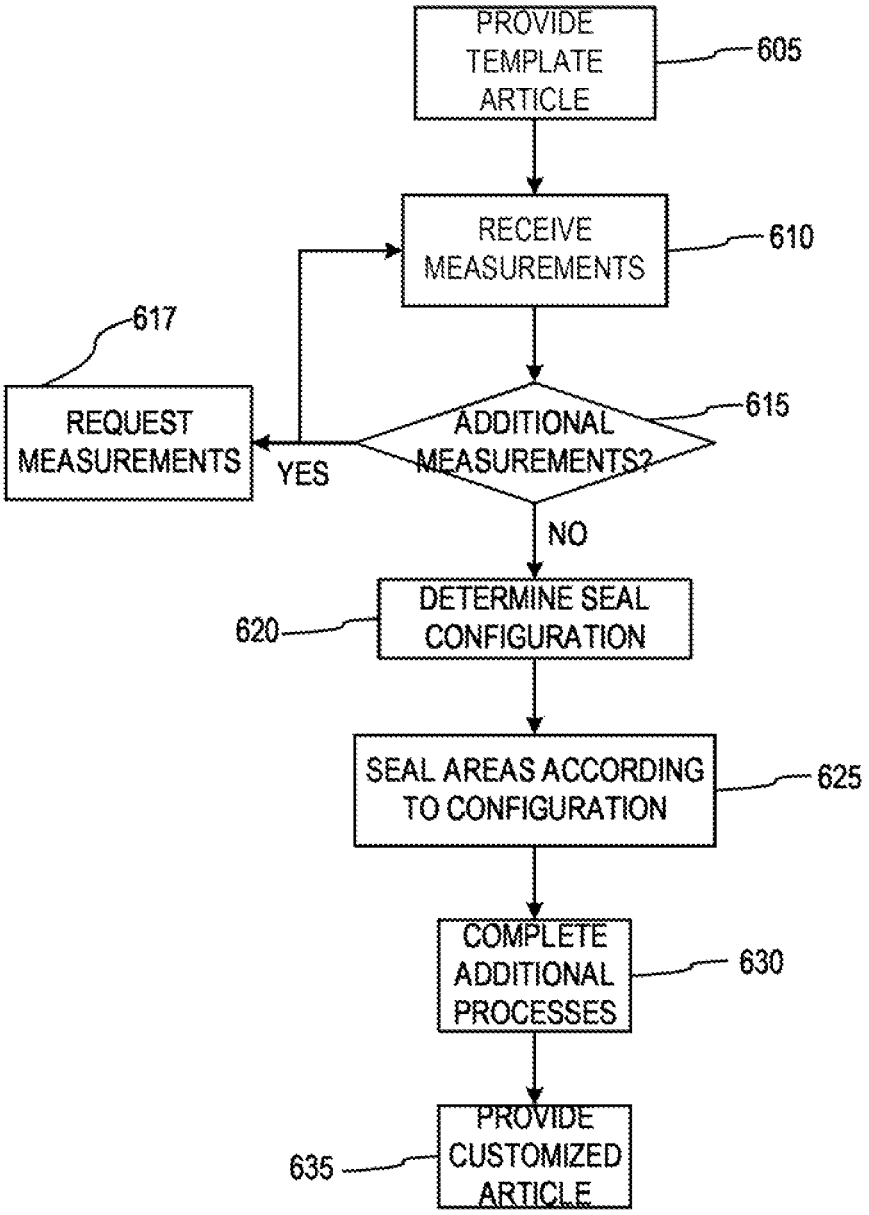
FIG. 6 depicts a flow diagram of a method of forming a compression device according to an embodiment.

FIG. 6 depicts a flow diagram of a method of forming a compression device according to an embodiment. The method may include providing 605 a template article. In one embodiment, providing 605 a template article may include fabricating or forming the template article. In another embodiment, providing 605 a template article may include receiving, from a third party, one or more pre-fabricated template articles. The template article may be generally shaped and sized to fit a particular anatomical area of an average patient, in which an average patient may be defined as a patient having average-sized anatomical measures derived from a plurality of patients of the same gender, height, weight, age, or other grouping of patients. For example, the template article may be shaped and sized to represent a garment such as, for example, a vest, a long sleeve shirt, a short sleeve shirt, a girdle, a corset, shorts, pants, leggings, a sleeve, a glove, a boot, or a hat. In some embodiments, the template article may be formed to accommodate varying sizes of patients, such as, for example, extra small (XS), small (S), medium (M), large (L), extra-large (XL), extra-extra-large (XXL), and/or the like. In particular embodiments, the template article may be formed more specifically, such as garments having a particular waist size, chest size, and/or inseam.

The template article may be formed from a material that allows for the various components described herein to be formed and/or incorporates the various components when the template article is modified into the bespoke compression therapy device. For example, the bespoke compression therapy device may be adapted to incorporate or incorporates one or more valves, manifolds, vacuums, pumps, transducers, sensors, and/or the like. Illustrative materials may include one or more of a fabric, a polymer, a polymer-containing material, natural rubber, synthetic rubber, and/or the like. Thus, the material may be sealable via plastic welding, heat sealing, and/or the like. In some embodiments, the material may be constructed such that it can stably receive or contain a fluid, particularly a pressurized fluid, without allowing the fluid to leak.

A plurality of measurements may be received 610 for a bespoke compression therapy device manufactured by modifying the template article that has been provided 605. In some embodiments, the measurements may specify a particular template article to be customized, such as a particular type of article and/or general size, as described herein. In some embodiments, a determination may be made as to the particular type of compression article and/or a general size to be used. A determination 615 may be made as to whether additional measurements are necessary to determine the exact specifications of the bespoke compression therapy device. If additional measurements are needed, the additional measurements may be requested 617 and received 610.

If additional measurements are not needed, a seal configuration may be determined 620. The seal configuration may be determined 620 based upon the measurements received 610, the type and size of the template article used, the shape and size of the various anatomical areas in need of compression (i.e., shape and size of injured areas), and/or the like.

In various embodiments, the cell boundary seals may be sealed 625. In some embodiments, the cell boundary seals may be sealed 625 according to the determined 620 seal configuration. The method of sealing 625 is not limited by this disclosure, and may generally be any method now known or later developed. The method of sealing 625 may be selected based upon the type of material used for the cells. In some embodiments, the method of sealing 625 may be based on the location and/or configuration of the cell boundary seals to be sealed. For example, certain methods of sealing 625 may be more suitable for cell boundary seals that are spaced at a particular distance, cell boundary seals that have particular shapes and/or sizes, and/or the like. Illustrative methods of sealing may include, but are not limited to, plastic welding and heat sealing. Particular methods of sealing 625 may include, but are not limited to, hot gas welding, freehand welding, speed tip welding, extrusion welding, contact welding, hot plate welding, high frequency welding, injection welding, ultrasonic welding, friction welding, spin welding, laser welding, solvent welding, chemical welding, and the like. Hot gas welding, also known as hot air welding, may comprise a welding technique that uses heat. A specially designed heat gun, called a hot air welder, may produce a jet of hot air that softens the various parts to be joined with a polymeric filler rod.

High frequency welding, which is also known as dielectric sealing or radio frequency (RF) heat sealing, may include heating various polymers with chemical dipoles, such as, for example, polyvinyl chloride (PVC), polyurethane, various polyamides (PA), various acetates, nylon, polyethylene terephthalate (PET), polyethylene-vinyl acetate (PEVA), ethylene-vinyl acetate (EVA), and acrylonitrile butadiene styrene (ABS) plastic. The polymers may be heated with high frequency electromagnetic waves, which allows the various polymers to soften and join together. In some embodiments, the heating may be localized to a particular area, such as the sealable boundaries. In some embodiments, the process may be continuous until all of the necessary sealable boundaries have been sealed.

In some embodiments, a polymer may be induction-welded by formulating the polymer with one or more metallic or ferromagnetic compounds, called susceptors. The susceptors may absorb electromagnetic energy from an induction coil, become hot, and lose their heat energy to the surrounding material by thermal conduction. Two pieces of the polymer material may be placed on a table press that applies pressure to the polymer material. One or more dies may be used to direct the welding process. When the press comes together, high frequency waves (e.g., about 27.120 MHz) may be passed through the small area between the die and the table where the weld takes place. Such a welding process may result in a strong, consistent, leak-proof seal between the various cells.

Once the cell boundary seals have been sealed and tested 625, various additional processes may be completed 630, such as, for example, completion of various quality control processes, measuring, completing test inflations, and/or the like. The additional processes to be completed 630 may further include modification of one or more cells by the addition of components such as valves, sensors, and similar components. In some embodiments, in which the template article does not include any valve ports or valves, such valve ports and/or valves may be incorporated into the bespoke compression therapy device and/or the cells thereof. Such additional processes may be completed 630 to ensure the compression device functions as expected and is configured to fit the patient for whom it was made. As a final step, the customized compression device may be provided 635 to the patient. Additional processes may be completed if it is determined that the compression device does not fit the patient, such as requesting and receiving additional measurements and/or the like, as described in greater detail herein.

Figure 7:
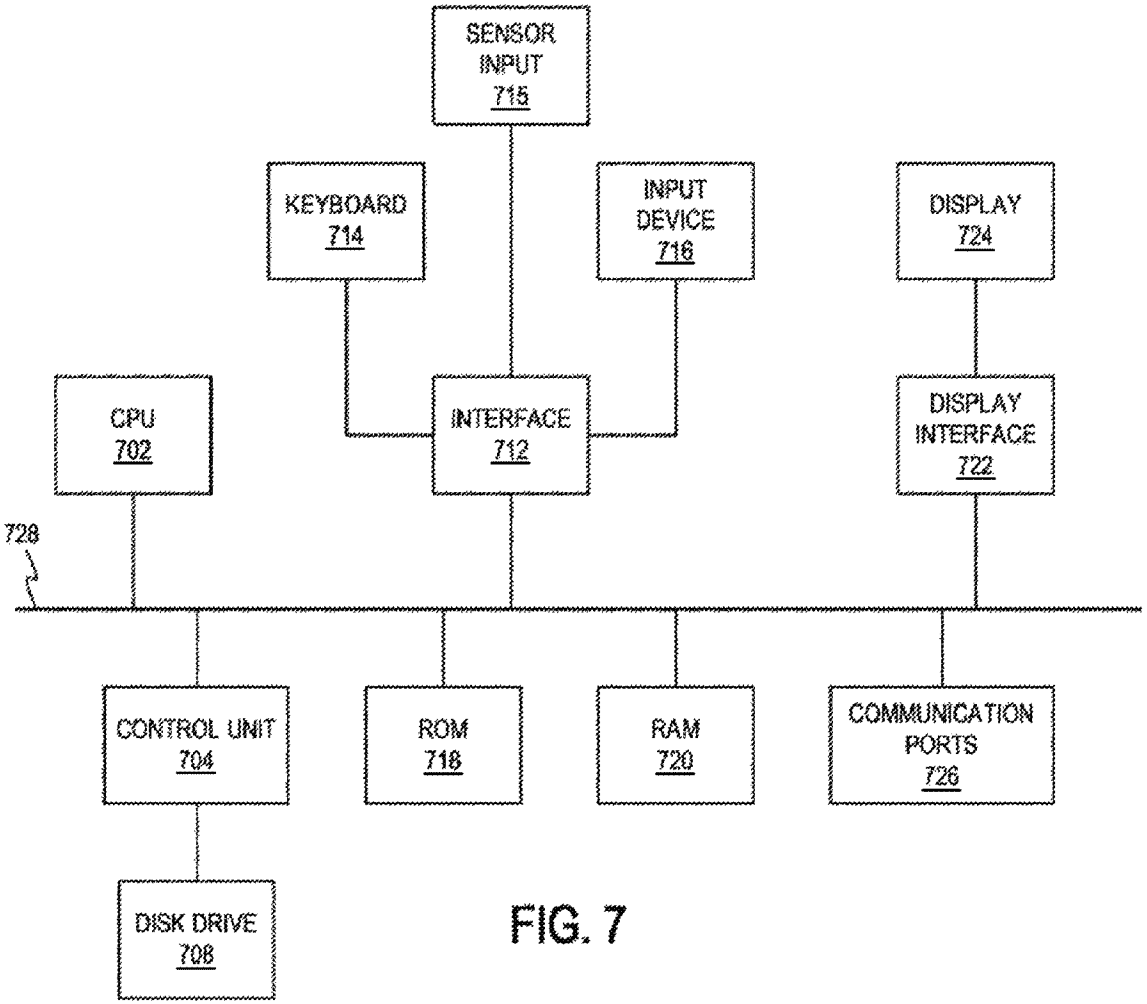
FIG. 7 depicts a block diagram of illustrative hardware that may be used to contain or implement program instructions for any of the various processes described herein.

FIG. 7 depicts a block diagram of an embodiment of hardware that may be used to contain or implement program instructions for any of the various processes described herein. In some embodiments, the hardware described with respect to FIG. 7 may be used to contain or implement program instructions for the controller 345 (FIGS. 3A and 3B). Accordingly, some or all of the below-described hardware may be incorporated in the controller 345. A bus 728 may serve as the main information highway interconnecting the other illustrated components of the hardware. CPU 702 or other computing device is the central processing unit of the system, performing calculations and logic operations required to execute a program. Read only memory (ROM) 718 is one embodiment of a static memory device and random access memory (RAM) 720 is one embodiment of a dynamic memory device.

A control unit 704 may provide an interface between the system bus 728 and one or more optional disk drives 708. These disk drives may include, for example, external or internal DVD drives, CD ROM drives, or hard drives. Such drives may also be used as non-transitory computer-readable storage devices.

Program instructions may be stored in the ROM 718 and/or the RAM 720. Optionally, program instructions may be stored on a computer readable medium such as a compact disk, a digital disk or other recording medium. Such program instructions may include a library of pre-loaded therapeutic protocols. Non-limiting examples of such program instructions may cause the controller to receive an input related to one or more therapeutic protocols from an input device, place at least two of the plurality of valves into the first state for a period of time based at least in part on the one or more therapeutic protocols, receive cell sensor data from at least one cell sensor, and transmit, to the output device, an output related to the data from at least one cell sensor. Additional instructions may cause the computing device to place at least two of the plurality of valves in one of the first state and the third state for a period of time based at least in part on data received from at least one cell sensor in operable communication with each of the at least two valves. Additional instructions may cause the computing device to place at least two of the plurality of valves in the first state substantially simultaneously or in an ordered sequence. Further instructions may cause the computing device to place the at least two of the plurality of valves in the third state, either substantially simultaneously or in an ordered sequence. Various instructions may be directed towards receiving sensor data, for example from pressure or flow sensors associated with the valves, and comparing them against appropriate threshold values as included in the therapeutic protocol. Similar instructions may be directed towards placing any of the valves into any of the possible cell states based on the sensor data values and threshold values according the therapeutic protocol.

An optional display interface 722 may permit information from the bus 728 to be displayed on the display 724 in audio, graphic or alphanumeric format. Communication with external devices may occur using various communication ports 726. For example, communication with the fill valve 320, exhaust valve 330, and/or the cell valves 325A-N (FIGS. 3A-3B) may occur via one or more communication ports 726. The controller 345 (FIGS. 3A-3B) may also provide command data over communication ports 726 to valves 320, 330, and 325A-N to direct their respective operations.

In addition to the components disclosed above, the hardware may also include an interface 712 which allows for receipt of data from input devices, such as a keyboard 714 or other input device 716, such as a mouse, remote control, pointing device and/or joystick. Such input devices may allow a user to choose a pre-programmed therapeutic protocol from a library of such protocols maintained by the controller, enter parameters into a preprogrammed protocol, or enter a new therapeutic protocol into the controller. In addition, the transducers 315A and 315B (FIG. 3B), the pressure sensors 355A-N, the flow sensors 350A-N, as well as sensors communicating data related to the change in shape or volume of the cells, such as a strain gauge 420 (FIG. 4C) and/or a plethysmograph 430 (FIG. 4D), may communicate sensor input 715 through interface 712 to the bus 728.

In an embodiment, the controller 345 (FIGS. 3A-3B) may store and/or determine settings specific to each cell. For example, the controller 345 may determine one or more pressure thresholds for each cell. Moreover, the controller 345 may prevent the compression device from being used improperly by enforcing requirements upon the system. For example, the controller 345 may be programmed so that distal cells in a therapeutic protocol are required to have higher pressure thresholds than proximal cells. The controller 345 may override instructions received from a user via the user interface that do not conform to such pressure threshold requirements. In an embodiment, the pressure thresholds of one or more cells may be adjusted to meet the pressure threshold constraints.

In a further embodiment, the controller 345 may provide a compression device user with an interface 712 to permit the user and/or health care provider to program the control to provide a variety of therapeutic protocols for patients. The interface 712 may be displayed on the control display 724, such as a flat panel display. Input devices 716 such as a mouse, keypad, or stylus may be used by the user to provide data to define a particular therapeutic protocol. The controller may record the protocols on a memory or disk device for future use. In one embodiment of the controller, a user may be presented with a list of previously stored therapeutic protocols from which to choose for a particular patient. In another embodiment, a user may define a therapeutic protocol for a patient on an as-needed basis. In another embodiment, a user may choose a stored protocol and modify it. It may be appreciated that such programming may be accomplished through any of a variety of methods. In one non-limiting example, a therapist or other health care professional may enter commands and/or parameters via a keyboard 714. In another non-limiting example, the therapist or other health care professional may use a mouse or touch screen to select one or more pre-programmed therapeutic protocols or parameters from a menu. In yet another non-limiting example, the therapist or other health care professional may program a protocol with help of a graphical interface presenting therapeutic protocol "primitives." The user may define a therapeutic protocol by selecting a group of graphical primitives representing cells, valves, sensors, and the like, and link them together to form a complete protocol. As one non-limiting example, a final graphical presentation of a therapeutic protocol may be presented on an output device as a flow-chart listing steps, cell inflation order, time between cell inflations/deflations, cell pressure hold parameters, and/or fluid flow rate or pressure thresholds.

In addition to storing protocols, the controller 345 may also record sensor readings obtained during a particular therapy session. Sensor readings may include, without limitation, cell pressures, cell volumes, cell inflation data, and/or air or vacuum air flow values. The controller 345 may also record patient related data such as blood pressure or blood oxygen saturation levels measured during a therapeutic session, as well as a date and time for the session. The controller 345 may also record therapy notes entered by the user.

The controller 345 may also include a number of communications interfaces to either a network or a wireless device such as a cell phone, an tablet computing device, a local area network device, and a wide area network device. Such communication interfaces may permit the controller to be monitored remotely by a clinician to obtain performance data or patient compliance data. Such communication interfaces may also permit a remote clinician to program the controller. As one non-limiting example, a physician or technologist may program a new therapeutic protocol in the controller. Alternatively, the care provider may transmit parameter data for a preprogrammed therapeutic protocol, or select a pre-programmed therapeutic protocol in the controller. In one embodiment, a cell phone may have an application that may bring up a user-friendly programming interface to permit ease of reprogramming. Alternatively, a remote computer may display a web-enabled display for programming, data assessment, and/or analysis.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation, no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

What is claimed is:

1. A bespoke compression therapy device comprising:

a wearable article comprising a template article having a first exterior surface, a second exterior surface, and a plurality of binding seams at one or more edges of the template article configured to secure the first exterior surface to the second exterior surface, wherein the wearable article defines a plurality of cells, each of the plurality of cells being delimited by at least one cell boundary seal, wherein each of the plurality of cells is configured to independently receive and emit an inflation fluid, wherein the at least one cell boundary seal is defined in accordance with a measurement of an anatomical characteristic of a user of the bespoke compression therapy device, and wherein at least one of the plurality of cells is localized in the wearable article in accordance with the anatomical characteristic of the user of the bespoke compression therapy device; and one or more valve ports, wherein each of the one or more valve ports is configured to receive a valve, and wherein the valve received by each of the one or more valve ports is configured to control a flow of the inflation fluid into and out of at least one of the plurality of cells.

2. The device of claim 1, wherein the wearable article has a shape of a garment.

3. The device of claim 1, wherein the first exterior surface and the second exterior surface each independently comprises one or more of a fabric, a polymer, a polymer-containing material, a urethane, a polymer coated fabric, a urethane coated fabric, a natural rubber, and a synthetic rubber.

4. The device of claim 1, wherein the measurement of the anatomical characteristic comprises one or more of a foot size, an ankle circumference, a calf circumference, a lower leg length, a knee circumference, a thigh circumference, an upper leg length, a hip circumference, a waist circumference, an abdomen circumference, a chest circumference, a bust size, a torso length, a shoulder circumference, a neck circumference, a head circumference, an upper arm circumference, an upper arm length, an elbow circumference, a lower arm length, a lower arm circumference, a wrist circumference, and a hand size.

5. The device of claim 1, wherein the at least one of the plurality of cells is configured to be localized proximate to one or more of the user's foot, ankle, lower leg, knee, upper leg, hip, waist, abdomen, chest, bust, torso, shoulder, neck, head, upper arm, elbow, lower arm, wrist, and hand.

6. The device of claim 1, further comprising:

a manifold in fluid communication with the at least one valve; and a pump in fluid communication with the manifold, wherein the pump is configured to deliver the inflation fluid through the manifold to one or more of the plurality of cells via the valve received by each of the one or more valve ports such that the plurality of cells inflate to form a shape in accordance with the anatomical characteristic of a user.

7. The device of claim 1, further comprising at least one sensor in communication with the at least one cell.

8. The device of claim 7, wherein the at least one sensor comprises one or more of a fluid flow sensor, a pressure sensor, and a material physical deformation sensor.

9. The device of claim 1, further comprising a retention device.

10. The device of claim 9, wherein the retention device comprises one or more arms, straps, sleeves, wraps, adhesive components, buttons, snaps, and hook and loop systems.

11. A method of providing a bespoke compression therapy device to a patient, the method comprising:

measuring at least one anatomical area on the patient where compression is desired thereby obtaining at least one measurement;

providing the at least one measurement to a provider of the bespoke compression therapy device;

receiving, from the provider, the bespoke compression therapy device comprising a template article modified to incorporate a plurality of sealed cells, wherein at least one of the plurality of sealed cells is configured so that, when inflated, the sealed cell corresponds to the at least one measurement;

placing the bespoke compression therapy device on the patient; and inflating the at least one sealed cell.

12. The method of claim 11, wherein measuring at least one anatomical area comprises measuring one or more of a foot size, an ankle circumference, a calf circumference, a lower leg length, a knee circumference, a thigh circumference, an upper leg length, a hip circumference, a waist circumference, an abdomen circumference, a chest circumference, a bust size, a torso length, a shoulder circumference, a neck circumference, a head circumference, an upper arm circumference, an upper arm length, an elbow circumference, a lower arm length, a lower arm circumference, a wrist circumference, and a hand size.

13. The method of claim 11, wherein measuring at least one anatomical area comprises measuring at least one anatomical area manually by a healthcare provider, manually by a non-healthcare provider, or automatically by a measuring device.

14. The method of claim 11, wherein providing the measurement to a provider of the bespoke compression therapy device comprises providing the measurement to a manufacturer, a representative of a manufacturer, and a compression therapy service provider.

15. The method of claim 11, further comprising determining a fitness of the bespoke compression therapy device.

16. The method of claim 15, wherein determining a fitness of the bespoke compression therapy device comprises determining one or more of:

whether the device fits over or is adjacent to the at least one anatomical area; and whether the at least one of the plurality of sealed cells is configured to stably receive and emit an inflation fluid.

17. A method of manufacturing a bespoke compression therapy device, the method comprising:

providing a template article that is configured to generally correspond to at least one anatomical feature of one or more patients, wherein the template article is configured to be modified to incorporate one or more sealed cells;

receiving a measurement of at least one target anatomical feature of a patient;

determining a configuration of one or more cell boundary seals to be incorporated into the template article, wherein the one or more cell boundary seals defines one or more locations of the one or more sealed cells, and wherein the one or more sealed cells are localized to provide a pressure to the at least one target anatomical feature; and incorporating the one or more cell boundary seals into the template article, thereby creating the sealed cells according to the determination, and forming, thereby, the bespoke compression therapy device.

18. The method of claim 17, wherein incorporating the one or more cell boundary seals into the template article comprises one or more of hot gas welding, freehand welding, speed tip welding, extrusion welding, contact welding, hot plate welding, high frequency welding, injection welding, ultrasonic welding, friction welding, spin welding, laser welding, solvent welding, hot air welding, and chemical welding.

* * * * *